United States Patent [19]

Malden

[11] 4,094,736

[45] June 13, 1978

[54] PREPARATION OF CELLULOSIC MATERIALS

[75] Inventor: Peter James Malden, Lostwithiel, England

[73] Assignee: English Clays Lovering Pochin & Company Limited, St. Austell, England

[21] Appl. No.: 808,529

[22] Filed: Jun. 21, 1977

[30] Foreign Application Priority Data

Jun. 23, 1976 United Kingdom ..... 26007/76

[51] Int. Cl.[2] ..... D21H 3/28; D21H 3/66

[52] U.S. Cl. ..... 162/175; 162/181 R; 162/181 D; 162/183; 106/308 C

[58] Field of Search ..... 162/175, 181 R, 181 A, 162/181 C, 181 D, 183; 106/308 C

[56] References Cited

U.S. PATENT DOCUMENTS

| | | | |
|---|---|---|---|
| 2,140,394 | 12/1938 | Ruff | 162/175 |
| 3,704,158 | 11/1972 | Rohan | 162/181 A |
| 3,873,336 | 3/1975 | Lambert et al. | 162/175 |

FOREIGN PATENT DOCUMENTS

| | | | |
|---|---|---|---|
| 2,230,613 | 12/1972 | Germany | 106/308 C |
| 1,429,796 | 3/1976 | United Kingdom | 162/175 |

*Primary Examiner*—S. Leon Bashore
*Assistant Examiner*—William F. Smith
*Attorney, Agent, or Firm*—Cushman, Darby & Cushman

[57] ABSTRACT

The invention relates to a process for preparing paper or cardboard in which starch and a mineral filler are incorporated into cellulosic fibres. The process uses a blend, which is prepared under specified conditions, of raw starch and starch phosphate. The procedure for incorporating the starch blend and the mineral filler into the cellulosic fibres is also specified.

24 Claims, No Drawings

PREPARATION OF CELLULOSIC MATERIALS

This invention concerns a filler material which is suitable for filling paper pulp and other cellulosic materials.

Mineral materials such as calcium carbonate, kaolin and titanium dioxide are well known as fillers for cellulosic materials. They can improve the opacity, whiteness and ink receptivity of paper in which they are contained but generally have a deleterious effect on the strength of the paper. Also, because the mineral materials are generally relatively cheap compared with the paper pulp the overall cost per unit weight of paper containing them is reduced. One problem associated with incorporating a mineral filler material in paper pulp is that the mineral particles must be relatively fine, i.e. of diameter about 50 microns or smaller, in order to confer the desirable improvements in opacity, whiteness and ink receptivity. If a mineral material has a particle size distribution such that substantially all of the particles are smaller than 50 microns there will generally be an appreciable proportion of particles having diameters of 1 or 2 microns or smaller. Many of these finer particles will not be retained in the mat of cellulosic fibres which forms the paper with the result that some of the mineral filler material passes through the wire of the papermaking machine in the form of what is known in the paper-making art as "white water". It is generally difficult to recover mineral particles and cellulose fibres from white water but regulations regarding industrial effluents are widely being made more stringent so that foreign solid materials must be removed from effluent water before it is discharged to a river or stream.

An object of this invention is to provide an improved filler material for cellulosic products which confers the advantages of improved brightness, opacity and ink receptivity and which has less adverse effect on the strength of the paper as compared with a conventional filler, and is substantially completely retained in the mat of cellulosic fibres during the paper-making process.

According to the present invention, there is provided a process for preparing paper or cardboard which contains a filler composition, which process comprises (a) suspending raw starch in sufficient cold water to form a suspension containing about 3 to 10% by weight of starch solids; (b) heating the suspension thus obtained, with stirring, to a temperature in the range 75°-90° C; (c) adding a starch phosphate to sufficient water so as to form a suspension or solution containing about 1-10% by weight of the starch phosphate; (d) adding the starch phosphate solution or suspension to the suspension of raw starch and raising the temperature of the mixture thus obtained to within the range of 75°-95° C. and holding its temperature at that level for about 5 to 10 minutes; (e) agitating the solution of mixed starches thus obtained in a high shear mixer for from about 1 to 5 minutes and thereafter allowing the mixed starch solution to cool; (f) adding the cooled mixed starch solution to a dry powdered mineral filler material so that the resultant mixed suspension contains about 5-25% dry weight of the starch mixture and about 95-75% by weight of dry mineral; (g) either adding the mixed suspension thus obtained to a suspension of cellulosic fibres, coagulating the mixed starches by adding a solution of a salt having a multivalent cation and thereafter raising the pH of the suspension to above 5.5; or treating the mixed suspension obtained after step (f) with a solution of a salt having a multivalent cation so as to coagulate the starch mixture, raising the pH of the resultant material to above 5.5 and thereafter adding the resultant suspension to a suspension of cellulosic fibres; and (h) forming the suspension of cellulosic fibres containing the mixture of mineral and coagulated mixed starches into sheet material.

The raw starch employed is preferably potato starch. The starch phosphate employed advantageously has a degree of substitution in the range of from 0.02 to 0.1. The degree of substitution is the number of phosphate groups (calculated as orthophosphate groups) in the starch phosphate per anhydro glucose unit. Each anhydro glucose unit of the starch polymer has three replaceable hydroxyl groups, any of which may be esterified by contact with an inorganic phosphate, for example an orthophosphate, metaphosphate, polymetaphosphate, pyrophosphate or tripolyphosphate, to form an ester having the general formula:

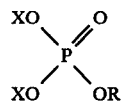

where X is hydrogen or a univalent metal and R represents the anhydro glucose units of starch.

Forms of starch other than potato starch may be employed, for example that prepared from corn (maize), wheat, rice, and tapioca.

The quantities of starch and starch phosphate employed are preferably such that the starch mixture contains from 5% to 20% by weight of the starch phosphate and from 80-95% by weight of the raw starch.

In step (g), the salt having a multivalent cation is preferably an aluminium or calcium salt, e.g. aluminium sulphate or calcium chloride; the pH is preferably raised to a value within the range from 5.8 to 6.5 by addition of an alkali.

The addition of the mixed starch solution to the dry powdered mineral filler, and the mixture of the resultant mixed suspension with cellulosic fibres, is desirably effected with gentle stirring.

In step (c) the starch phosphate may conveniently be added to cold water or water at ambient temperature to form a suspension. Depending on the degree of substitution of the starch phosphate, the material either swells or dissolves in cold water.

The mechanical working of step (e) improves the behaviour of the starch mixture. The two types of polymer become entangled as a result of the high shear mixing, and this tends to improve the homogeneity of coagulation subsequently effected, as well as improving the association between the mixed starches and the mineral filler particles. Because of the improvement in coagulation effected thereby, the amount of starch which remains in solution is reduced; this is advantageous, because dissolved starch in water ultimately recovered from, for example, the paper making process causes difficulties in the reuse of the water.

The mineral filler employed may be any of those conventionally used in filling cellulosic materials.

The invention will be illustrated by the following Examples.

EXAMPLE 1

Preparation of starch/mineral mixture 4.5 g of hydrated potato starch were mixed with 60 ml of cold water and the mixture heated with stirring on a steam bath to 85° C. To the resulting starch solution there was added a suspension of 0.5 g. of starch phosphate of degree of substitution 0.07 in 10 ml. of cold water, the container for the starch phosphate being washed with cold water and the washings added to the potato starch solution to ensure that all the starch phosphate was mixed in. The resultant mixture was then heated on a steam bath with stirring to 85° C. and held at that temperature for 5 minutes. Water was then added to adjust the total concentration of starch in the solution to 10% by weight. The diluted solution was heated to 85° C. and the hot solution stirred vigorously in an M.S.E. Homogeniser provided with cutter blades for 3 minutes at about one third of the maximum rotational speed of the homogeniser. The solution was then cooled to give a liquid which was mobile but had "long flow" properties when poured.

4.5 g. of a powdered English china clay having a particle size distribution such that 45% by weight consisted of particles having an equivalent spherical diameter smaller than 2 microns and 15% by weight of particles having an equivalent spherical diameter larger than 10 microns were mixed by hand with 10 g of the starch solution prepared as described above and the mixture was stirred by hand until uniform.

EXAMPLE 2

Preparation of paper hand sheets

Hand sheets of paper filled with starch/clay agglomerates in accordance with the invention were prepared in the following way.

400 g. of bleached sulphite spruce pulp were soaked in 10 liters of water for 4 hours and the mixture was then disintegrated for 10 minutes in a turbine mixer manufactured by Etablissements Cellier of Aix-les-Bains, France, the impeller rotating at a speed of 220 r.p.m. The contents of the mixer were washed out with a further 10 liters of water and transferred to a laboratory beater where a further 2 liters of water were added and the mixture beaten for 16½ minutes. At this stage the stock contained approximately 1.8% by weight of dry pulp. The beating time was chosen to give the optimum compromise between brightness and strength properties of the stock; this was such that the beaten pulp had a Canadian Standard Freeness of about 300–320 cc. (This is measured by placing a 1 liter sample of an aqueous suspension containing 0.3% by weight of fibres in a container provided with a wire mesh base covered with a water tight hinged lid. The hinged lid is swung open to allow water draining through the pulp and through the wire mesh to fall into a large funnel having a narrow orifice at the base of its central stem and an overflow pipe a given height above the bottom orifice. The freer the pulp, the more rapidly water falls into the funnel, and the more water overflows down the pipe provided because the orifice is too narrow to accommodate the total flow of water. The volume of water overflowing is measured in a measuring cylinder and the Canadian Standard Freeness is expressed in cubic centimeters of water). The following table gives the "single sheet brightness" (percentage reflectance of violet light of wavelength 458 nm. from the surface of a single sheet of paper having a dry weight of 60 grams per square meter) and the burst ratio for paper sheets formed from a bleached sulphite softwood pulp beaten in a Valley "Niagara" beater to different Canadian Standard Freeness values:

Table I

| Canadian Standard Freeness (c.c.) | Single Sheet Brightness (%) | Burst Ratio |
|---|---|---|
| 642 | 70.5 | 18 |
| 468 | 65.0 | 35 |
| 280 | 59.3 | 47 |
| 137 | 55.3 | 50 |

It can be seen that increasing the beating time so as to reduce the freeness from 280 to 137 results in a small improvement in strength at the expense of a significant drop in brightness.

800 ml. of the stock were then made up to 2 liters with water and disintegrated in a laboratory disintegrator which was operated for 15,000 revolutions of the impeller. The volume of stock was made up to 4 liters and the consistency was checked by filtering and evaporating to dryness a small sample and weighing the residue. Water was added if necessary to reduce the consistency to 0.3% by weight of dry pulp. Filler was added and stirred in by hand at the rate of 14.5 g of filler per 4 liters of paper fibre stock.

Hand sheets were prepared from the stock by pouring 400 ml. batches of the stock on to a suitable wire screen and removing surplus water.

EXAMPLE 3

Seven 14.5 g. batches of starch/clay mixture were prepared as in Example 1 and each batch was treated with a different quantity of a solution of aluminium sulphate containing 5 g. of $Al_2(SO_4)_3.16H_2O$ per 100 ml. of solution. The pH was adjusted to 6.0 with sodium hydroxide, all mixing being performed by hand so that the reaction product of clay with the starch was subjected only to very small shearing forces. The clay with its coating of coagulated starch in the form of sliver-shaped agglomerates was then mixed with 4 liters of paper pulp stock and formed into hand sheets as described in Example 2 above. The hand sheets from each batch were tested for bursting strength by the test prescribed in TAPPI Standard No. T 403 os-74. The bursting strength is defined as the hydrostatic pressure in kilonewtons per square meter required to produce rupture of the material when the pressure is increased at a controlled constant rate through a rubber diaphragm to a circular area 30.5 mm in diameter. The area of the material under test is intially flat and held rigidly at the circumference but free to bulge during the test. Samples of each sheet were also weighed dry and then incinerated, the weight of the dry sample being used to determine the weight per unit area of the paper in grams per square meter and the weight of ash to calculate the percentage of filler material (clay and starch) based on the weight of dry fibres after allowing for the loss on ignition of the filler and also to calculate the percentage by weight of the added filler material which was actually retained by the fibres.

The burst strengths were divided by the weight per unit area of the paper to give a burst ratio and the burst ratio for each sheet of filled paper was then expressed as a percentage of the burst ratio for a sheet of paper prepared from the same stock but containing no filler.

As a comparison, hand sheets were also prepared from the same paper stock but containing as the filler only the English china clay described in Example 1. Burst ratios and percentages by weight of inorganic filler material were determined for two different filler loadings.

The results are set forth in Table II below:

Table II

| | ml. of 5% aluminium sulphate solution added to 14.5 g. of Starch/Clay mix | percentage retention of filler | % by weight of filler on fibres | Burst ratio-percentage of unfilled value |
|---|---|---|---|---|
| China Clay + Starch | 0.144 | 31 | 21 | 62 |
| Phosphate + | 0.29 | 53 | 32 | — |
| Potato Starch | 0.5 | 55 | 32 | 59 |
| Coagulated | 0.6 | 76 | 40 | — |
| with | | | | |
| Aluminium | 1.0 | 78 | 40 | 52.5 |
| Sulphate | 2.5 | 89 | 43 | 48 |
| | 3.0 | 92 | 44 | 46 |
| China Clay | — | 30 | 19.5 | 58 |
| only | — | 30 | 40 | 28 |

These results show that, for a given loading of filler, the strength of the paper is reduced less by the addition of china clay treated with a mixture of potato starch and starch phosphate coagulated by aluminium sulphate in accordance with the invention than by the addition of untreated china clay. However sufficient aluminium sulphate, i.e. at least 0.5 ml of 5% solution per 14.5 g. of starch/clay mix or about 0.17% by weight based on the total weight of filler, must be added in order to coagulate the starch and starch phosphate fully and thus achieve good retention of the filler and a good improvement in strength over that obtained with a similar quantity of untreated china clay. These results may be compared with the results hitherto obtainable as exemplified by U.S. Pat. No. 3,132,066. The first three entries in following Table III are derived from Example 23 of this U.S. Specification, while the remaining entries are derived from Table II above:

Table III

| Filler | Burst ratio-percentage of unfilled value | Percentage retention of filler |
|---|---|---|
| None | 100 | — |
| 1.4% $TiO_2$ (28% of 5%) | 78 (100 × 25/32) | 28 |
| 1.4% $TiO_2$/2% starch phosphate (Ex.4) | 280 (100 × 90/32) | 28 |
| 19.5% china clay | 58 | 30 |
| 40% china clay | 28 | 30 |
| 21% china clay/starch mixture | 62 | 31 |
| 32% china clay/starch mixture | 59 | 55 |
| 40% china clay/starch mixture | 52.5 | 78 |
| 43% china clay/starch mixture | 48 | 89 |
| 44% china clay/starch mixture | 46 | 92 |

The results from U.S. Pat. No. 3,132,066 are not directly comparable with the results obtained by the process of this invention because the quantity of filler used, as well as the nature of the filler, are very different from those employed in the process of the invention. It is well known that if starch is added to paper pulp in quantity similar to that used in U.S. Pat. No. 3,132,066 the burst strength of the paper formed from the treated pulp is greater than that of paper formed from untreated pulp. It is also known that the effect of adding titanium oxide, or other mineral filler, to the pulp is to reduce the burst strength of the paper formed. However in the particular case described in U.S. Pat. No. 3,132,066 the amount of titanium dioxide added is very small so it is not surprising that the beneficial action of the starch more than counteracts the deleterious action of the titanium dioxide. It is the aim of our invention to incorporate in the paper much greater quantities of filler without reducing the strength to an undesirable level and so produce a paper which has a higher proportion of the relatively inexpensive filler material and a smaller proportion of the expensive paper pulp.

The above results show that when titanium dioxide is treated with starch phosphate in accordance with U.S. Pat. No. 3,132,066 the retention of titanium dioxide is unaffected. However when china clay is treated with a mixture of potato starch and starch phosphate coagulated by aluminium sulphate in accordance with the invention not only is the strength of the paper for a given loading of filler increased, but the retention of the filler is increased also.

I claim:

1. A process for preparing paper or cardboard which contains a filler composition, which process comprises the steps of (a) suspending raw starch in sufficient cold water to form a suspension containing about 3 to 10% by weight of starch solids; (b) heating the suspension thus obtained, with stirring, to a temperature in the range 75°–95° C; (c) adding a starch phosphate to sufficient water so as to form a suspension or solution containing about 1–10% by weight of the starch phosphate; (d) adding the starch phosphate solution or suspension to the suspension of raw starch and raising the temperature of the mixture thus obtained to within the range of 75°–95° C. and holding its temperature at that level for about 5 to 10 minutes; (e) agitating the solution of mixed starches thus obtained in a high shear mixer for from about 1 to 5 minutes and thereafter allowing the mixed starch solution to cool; (f) adding the cooled mixed starch solution to a dry powdered mineral filler material so that the resultant mixed suspension contains about 5–25% dry weight of the starch mixture and about 95–75% by weight of dry mineral; (g) adding the mixed suspension thus obtained to a suspension of cellulosic fibres, coagulating the mixed starches by adding a solution of a salt having a multivalent cation and thereafter raising the pH of the suspension to above 5.5; and (h) forming the suspension of cellulosic fibres containing the mixture of mineral and coagulated mixed starches into sheet material.

2. A process according to claim 1, wherein the raw starch which is used is potato starch.

3. A process according to claim 1, wherein the starch which is used is maize, wheat, rice or tapioca starch.

4. A process according to claim 1, wherein the starch phosphate which is used has a degree of substitution in the range of from 0.02 to 0.1.

5. A process according to claim 1, wherein the quantities of starch and starch phosphate employed are such that the starch mixture contains from 5% to 20% by weight of the starch phosphate, and from 80 to 85% by weight of the raw starch.

6. A process according to claim 1, wherein the salt having a multivalent cation used in step (g) is selected from the group consisting of aluminium and calcium salts.

7. A process according to claim 6, wherein said salt is selected from the group consisting aluminium sulphate and calcium chloride.

8. A process according to claim 1, wherein the pH is raised, in step (g), to a value within the range from 5.8 to 6.5.

9. A process according to claim 1, wherein the water to which the starch phosphate is added is at ambient temperature.

10. A process according to claim 1, in which the mineral filler used is a clay mineral.

11. A process according to claim 10, wherein the mineral filler used is a kaolin clay.

12. A process for preparing paper or cardboard which contains a filler composition, which process comprises the steps of (a) suspending raw potato starch in sufficient cold water to form a suspension containing about 3 to 10% by weight of starch solids; (b) heating the suspension thus obtained, with stirring, to a temperature in the range 75°-95° C; (c) adding a starch phosphate having a degree of substitution in the range of from 0.02 to 0.1 to sufficient water so as to form a suspension or solution containing about 1-10% by weight of the starch phosphate; (d) adding the starch phosphate solution or suspension to the suspension of raw starch to form a starch mixture containing from 5% to 20% by weight of the starch phosphate and from 95% to 80% by weight of the raw starch and raising the temperature of the mixture thus obtained to within the range of 75°-95° C. and holding its temperature at that level for about 5 to 10 minutes; (e) agitating the solution of mixed starches thus obtained in a high shear mixer for from about 1 to 5 minutes and thereafter allowing the mixed starch solution to cool; (f) adding the cooled mixed starch solution to a dry powdered mineral filler material so that the resultant mixed suspension contains about 5-25% dry weight of the starch mixture and about 95-75% by weight of dry mineral; (g) adding the mixed suspension thus obtained to a suspension of cellulosic fibres, coagulating the mixed starches by adding a solution of aluminium sulphate or calcium chloride and thereafter raising the pH of the suspension to a value in the range 5.8 to 6.5; and (h) forming the suspension of cellulosic fibres containing the mixture of mineral and coagulated mixed starches into sheet material.

13. A process for preparing paper or cardboard which contains a filler composition, which process comprises the steps of: (a) suspending raw starch in sufficient cold water to form a suspension containing about 3 to 10% by weight of starch solids; (b) heating the suspension thus obtained, with stirring, to a temperature in the range 75°-95° C; (c) adding a starch phosphate to sufficient water so as to form a suspension or solution containing about 1-10% by weight of the starch phosphate; (d) adding the starch phosphate solution or suspension to the suspension of raw starch and raising the temperature of the mixture thus obtained to within the range of 75°-95° C. and holding its temperature at that level for about 5 to 10 minutes; (e) agitating the solution of mixed starches thus obtained in a high shear mixer for from about 1 to 5 minutes and thereafter allowing the mixed starch solution to cool; (f) adding the cooled mixed starch solution to a dry powdered mineral filler material so that the resultant mixed suspension contains about 5-25% dry weight of the starch mixture and about 95-75% by weight of dry mineral; (g) treating the mixed suspension obtained after step (f) with a solution of a salt having a multivalent cation so as to coagulate the starch mixture, raising the pH of the resultant material to above 5.5 and thereafter adding the resultant suspension to a suspension of cellulosic fibres; and (h) forming the suspension of cellulosic fibres containing the mixture of mineral and coagulated mixed starches into sheet material.

14. A process according to claim 13, wherein the raw starch which is used is potato starch.

15. A process according to claim 13, wherein the starch which is used is maize, wheat, rice or tapioca starch.

16. A process according to claim 13, wherein the starch phosphate which is used has a degree of substitution in the range of from 0.02 to 0.1.

17. A process according to claim 13, wherein the quantities of starch and starch phosphate employed are such that the starch mixture contains from 5% to 20% by weight of the starch phosphate, and from 80% to 85% by weight of the raw starch.

18. A process according to claim 13, wherein the salt having a multivalent cation used in step (g) is selected from the group consisting of aluminium and calcium salts.

19. A process according to claim 18, wherein said salt is selected from the group consisting of aluminium sulphate and calcium chloride.

20. A process according to claim 13, wherein the pH is raised, in step (g), to a value within the range from 5.8 to 6.5.

21. A process according to claim 13, wherein the water to which the starch phosphate is added is at ambient temperature.

22. A process according to claim 13, in which the mineral filler used is a clay mineral.

23. A process according to claim 22, wherein the mineral filler used is a kaolin clay.

24. A process for preparing paper or cardboard which contains a filler composition, which process comprises the steps of: (a) suspending raw potato starch in sufficient cold water to form a suspension containing about 3% to 10% by weight of starch solids; (b) heating the suspension thus obtained, with stirring, to a temperature in the range 75°-95° C; (c) adding a starch phosphate having a degree of substitution in the range of from 0.02 to 0.1 to sufficient water so as to form a suspension or solution containing about 1-10% by weight of the starch phosphate; (d) adding the starch phosphate solution or suspension to the suspension of raw starch to form a starch mixture containing from 5% to 20% by weight of the starch phosphate and from 95% to 80% by weight of the raw starch and raising the temperature of the mixture thus obtained to within the range of 75°-95° C. and holding its temperature at that level for about 5 to 10 minutes; (e) agitating the solution of mixed starches thus obtained in a high shear mixer for from about 1 to 5 minutes and thereafter allowing the mixed starch solution to cool; (f) adding the cooled mixed starch solution to a dry powdered mineral filler material so that the resultant mixed suspension contains about 5–25% dry weight of the starch mixture and about 95–75% by weight of dry mineral; (g) treating the mixed suspension obtained after step (f) with a solution of aluminium sulphate or calcium chloride so as to coagulate the starch mixture, raising the pH of the resultant material to a value in the range 5.8 to 6.5 and thereafter adding the resultant suspension to a suspension of cellulosic fibres; and (h) forming the suspension of cellulosic fibres containing the mixture of mineral and coagulated mixed starches into sheet material.

* * * * *